US005234654A

United States Patent [19]

Brooks

[11] Patent Number: 5,234,654

[45] Date of Patent: Aug. 10, 1993

[54] CONCRETE FORMING SYSTEM

[76] Inventor: Clifford D. Brooks, 4480 Ohio Ave., NE., Roanoke, Va. 23019

[21] Appl. No.: 842,498

[22] Filed: Feb. 27, 1992

[51] Int. Cl.[5] ..... E01C 7/00; E04G 17/00

[52] U.S. Cl. ..... 264/219; 24/573.1; 24/585; 249/2; 249/3; 249/4; 249/207; 249/213; 249/219.1; 264/31; 403/386

[58] Field of Search ..... 249/2, 3, 4, 33, 219.1, 249/219.2, 207, 216, 190, 45, 18, 38, 40, 218, 213, 205; 24/573.1, 585; 403/386, 397, 398, 400; 264/219, 31, 333

[56] References Cited

U.S. PATENT DOCUMENTS

| | | | |
|---|---|---|---|
| 995,630 | 6/1911 | Naugle | 249/9 |
| 1,202,269 | 10/1916 | Cramer | 249/8 |
| 1,755,960 | 4/1930 | Kohler | 249/216 |
| 2,107,427 | 2/1938 | Schwarzler | 249/33 |
| 2,133,574 | 10/1938 | Roemisch | 249/213 |
| 2,378,850 | 6/1945 | Hyre | 249/216 |
| 2,711,573 | 6/1955 | Bliss | 269/102 |
| 2,727,294 | 12/1955 | Arrighini | 249/47 |
| 2,772,468 | 12/1956 | Heltzel | 249/3 |
| 2,973,567 | 3/1961 | Brow, Jr. et al. | 249/207 |
| 3,103,730 | 9/1963 | Carlton | 249/191 |
| 3,300,920 | 1/1967 | Skaare | 52/150 |
| 3,881,681 | 5/1975 | Sumpter et al. | 249/3 |
| 3,926,404 | 12/1975 | Lovisa et al. | 249/213 |
| 4,193,573 | 5/1980 | Kinnucan, Jr. | 249/9 |
| 4,247,073 | 1/1981 | Vario | 249/190 |
| 4,257,571 | 3/1981 | Franks | 249/207 |
| 4,321,024 | 3/1982 | Terraillon | 425/111 |
| 4,533,112 | 8/1985 | Santos, Jr. et al. | 249/3 |
| 4,943,023 | 7/1990 | Becker | 248/302 |

*Primary Examiner*—Jay H. Woo
*Assistant Examiner*—James P. Mackey
*Attorney, Agent, or Firm*—Christensen, O'Connor, Johnson & Kindness

[57] ABSTRACT

A concrete forming system including an elongated member for extending from an exterior portion of the forming system to an interior portion of the forming system whereby the concrete or other pourable formable material exerts pressure on the interior portion of the elongated member and secures it with respect to the form members. A slidable member fits onto the exterior portion of the elongated member, the elongated member and the slidable member are secured to one another through perforations provided in both and through use of a securing pin to hold them rigid with respect to the formed border.

17 Claims, 3 Drawing Sheets

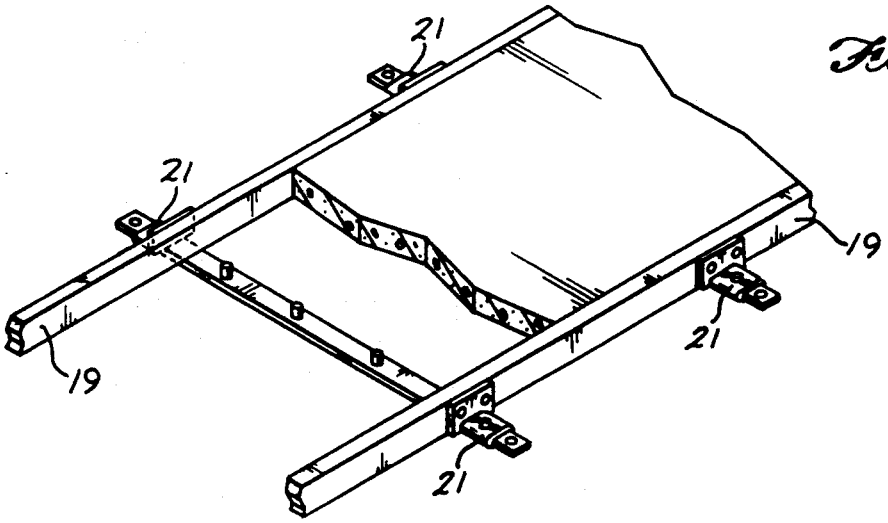
Fig. 1.
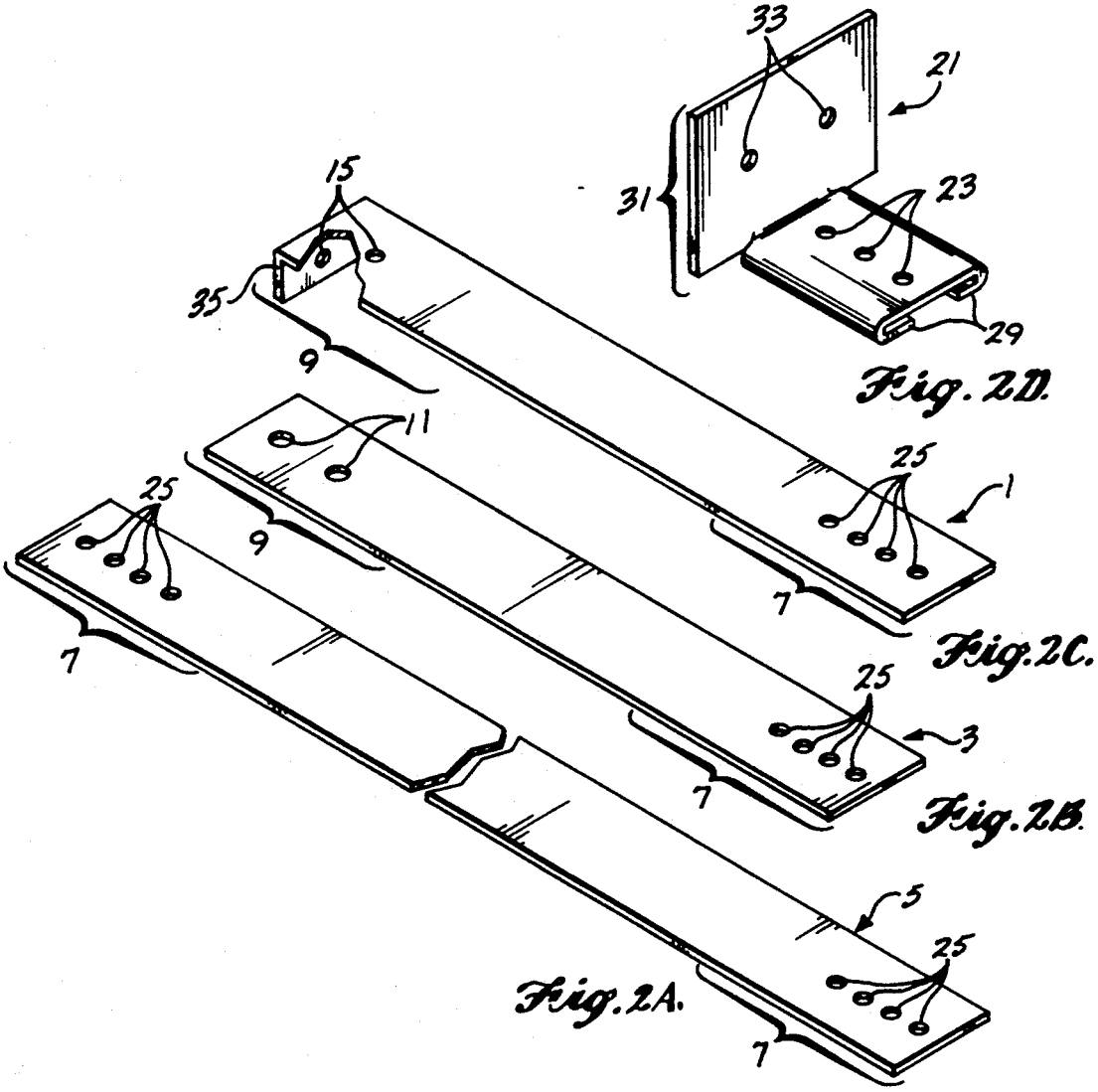
Fig. 2D.
Fig. 2C.
Fig. 2B.
Fig. 2A.

CONCRETE FORMING SYSTEM

FIELD OF THE INVENTION

The present invention relates to a method and apparatus for arranging a substantially vertical concrete forming system around the periphery of an area for receiving concrete at its interior.

BACKGROUND OF THE INVENTION

It is customary practice in concrete forming systems, including the forming of sidewalks, driveways and concrete pads for structures, to rely primarily on exterior form supports. U.S. Pat. No. 3,300,920 to Skaare and No. 3,881,681 to Sumpter, et al., both show forming systems that they suggest are easier to install, remove and adjust than the more commonly used wooden stake and brace forming systems.

Support for most forming systems, primarily the wooden stake and brace type systems, directly depends on the rigidity of the soil surrounding the exterior of the forming system. The soil often dictates the number of braces and supports required to obtain adequate rigidity in the form structure and to maintain rigidity during the pouring and finishing of the concrete. In an exterior support system, the greater the thickness of the concrete that the forms must support, the greater the pressure applied to the form; hence the need for additional exterior bracing to support the form. Relying entirely on exterior support often means hundreds of wooden stakes and braces which in turn require extensive time and labor to install. This ultimately results in greater costs to both the contractor and the end user or purchaser.

This prior art approach is not nearly as critical in, for example, sidewalks or thin slabs of concrete, i.e., 2 to 4-inch thick pads. However, concrete or any pourable formable material being placed in thicknesses greater than about 4 inches increases the pressure exerted on the forming system to a degree that it becomes difficult to prevent warping of the forms or even failure of the form system. In either circumstance, the end product is not as aesthetically pleasing as it could be and may require additional modifications to create a workable and visually pleasing concrete structure.

An alternative approach to the exterior support forming system has been to rely on certain interior support systems. This has been more applicable to wall structures than to concrete pads. However, interior support systems can also work efficiently with respect to concrete pads. An interior support system relies substantially on the weight of the concrete pressing down on various bracing elements in the interior of the concrete which in turn transfer the support to the exterior form structure. Hence, the greater the thickness of the concrete, the greater the weight or pressure on the interior support systems and hence the more support transferred to the exterior form.

U.S. Pat. No. 2,133,574 and No. 3,926,404 are directed at tying two forming walls together to provide support for concrete placed in a wall structure until the concrete is properly cured. In practicing the inventions of these patents it is necessary to leave a portion of the forming structure, i.e., the interior connecting supports, in the concrete as part of the permanent structure once the forms have been removed. Similar cross support methods are suggested in U.S. Pat. No. 995,630, and No. 1,202,269, and No. 2,727,294; and No. 2,973,567; and No. 4,257,571 and No. 4,321,024. These patents generally require that a brace or support be maintained across or along the top surface of the concrete; this upper surface however, is generally the finished surface of the concrete. These upper supports can later be removed once the concrete has reached a semi-cured state, i.e., it is rigid enough to maintain its form without the need for form supports.

In any event, depending on the final finish to be placed on the concrete, cross braces on the upper portion of a forming system can interfere with both the placement and finishing of the concrete. Again, this interference increases time, labor and material costs. In some instances, it is impossible to remove the brace during the concrete finishing process. This will typically result in a permanent line or discoloration on the finished surface of the concrete. And, depending on the use of the concrete structure, such flaws could mean additional work including grinding or grouting to create an acceptable finished concrete product.

In addition, since the cross support systems described above must obtain their relative strengths from an opposing form structure, it is necessary that the individual opposing forms be relatively close together. This requirement can restrict such forming systems to narrow structures such as concrete walls or curbs. Should it become necessary to use cross-tying form systems in wider applications, material costs become important since a greater portion of the form system must remain in the cured concrete. Generally, such cross-tying forming systems work well for wall structures not exceeding 18 inches in thickness or sidewalks not exceeding 6 to 8 feet in width. These systems typically become uneconomical and impractical when placing large slabs of concrete, i.e., slabs having at least one dimension greater than 8 feet or when, for example, a slab is placed against an existing structure where only one outside form is used, thus making it difficult to perform any cross-tying.

SUMMARY OF THE INVENTION

In accordance with the present invention there is provided an apparatus for securing a form member in place while a pourable formable material is placed at the form's interior. The apparatus comprises a flat elongated member for extending from the interior where the concrete is to be placed, to an area outside the form, a support member for slidably engaging the elongated member, means for securing the support member in a fixed position along the elongated member, and means for immobly securing the elongated member with respect to the form member.

Further, in accordance with the present invention there is provided a method for retaining a form member having in place while a pourable formable material is placed at the form's interior. The method comprises first securing a substantially flat elongated member having an exterior portion extending outside the form member and an interior portion extending inside the form member. The interior portion of the elongated member rests underneath the pourable formable material and is subject to the pressures of such material. This pressure is transferred along the flat elongated member to a sliding member on the exterior end of the elongated member. The sliding member has a upwardly extending lip for resting against and providing support for the form member. The elongated member and slidable member are secured in position and connected to one another through perforations provided in both the elongated member and the slidable member.

Due to the movable relationship between the elongated member and the support member, the present invention is easily adjusted to provide a proper contour for the exterior edge of the concrete pad. The present invention eliminates the need for external bracing in a concrete forming system by obtaining its support from the interior of the forming system. The weight of the concrete tends to prevent movement of the elongated member and the support member secured thereto.

The present invention typically reduces the time, labor and material costs associated with placing concrete. The present invention eliminates the need to use hundreds of wooden stakes and braces, or alternative exterior forming devices, in order to acquire the necessary support for the forming system. The present invention reduces the need to rely heavily on soil stability and the difficulties associated with driving stakes into rocky or firm clay soils.

BRIEF DESCRIPTION OF THE DRAWINGS

FIG. 1 is an isometric view illustrating the use of the present invention for forming sidewalks.

FIGS. *2a, 2b* and *2c* are isometric views showing three (3) embodiments of the elongated member;

FIG. *2d* is an isometric view of a preferred embodiment of a vertical support member.

Figure 3:
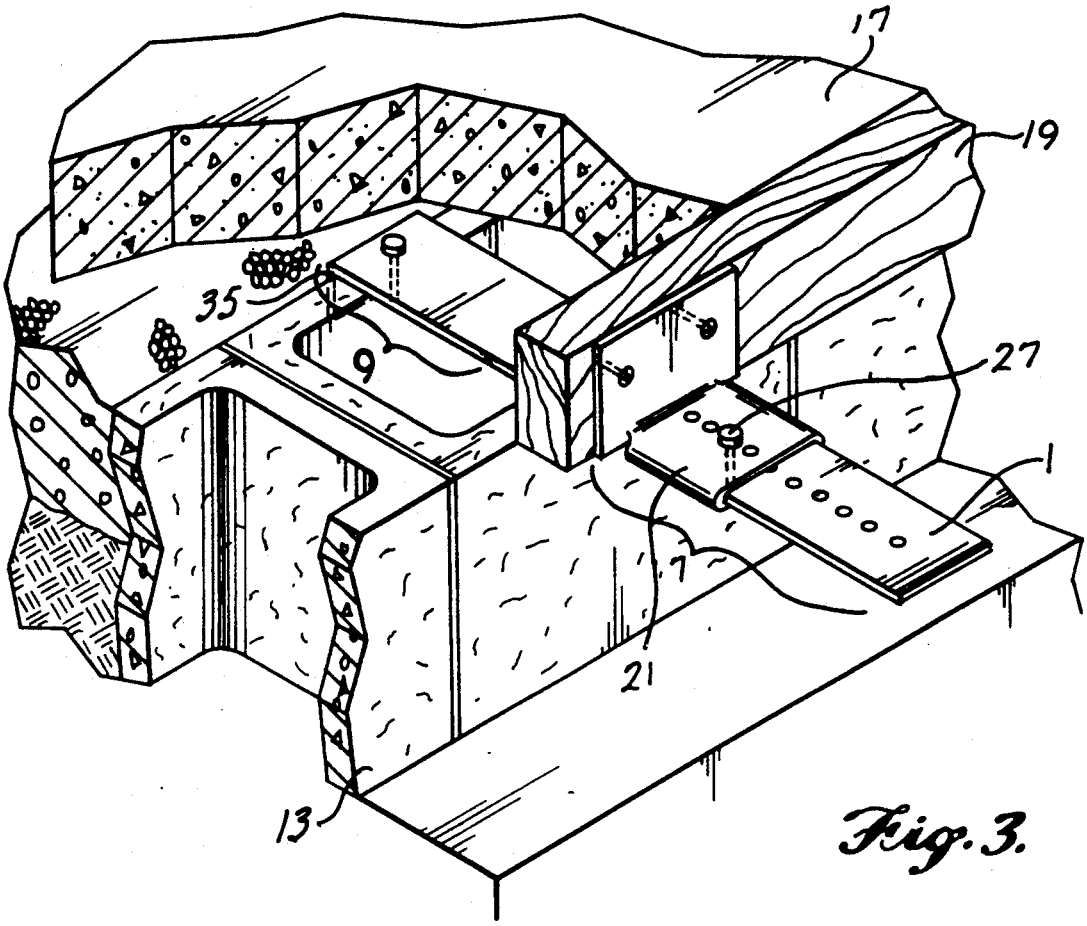

FIG. 3 is an isometric view of one embodiment of the present invention mounted on a cinder block.

Figure 4:
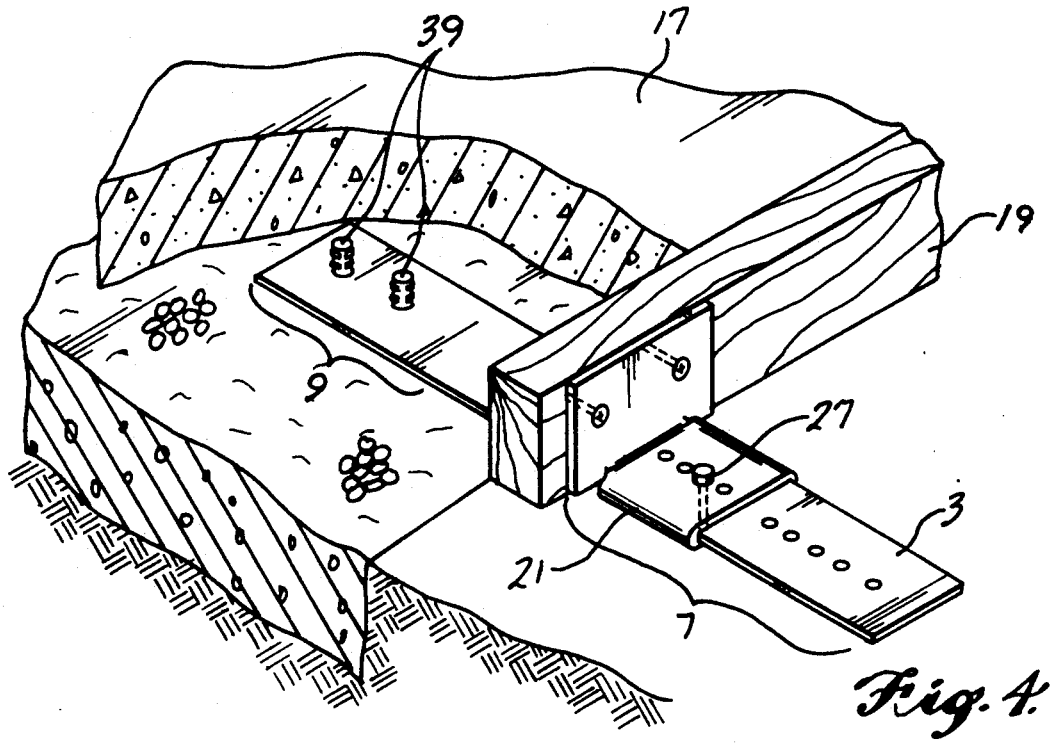

FIG. 4 is an isometric view of the present invention showing another embodiment where the present invention can be used with less rigid interior structures including soil.

Figure 5:
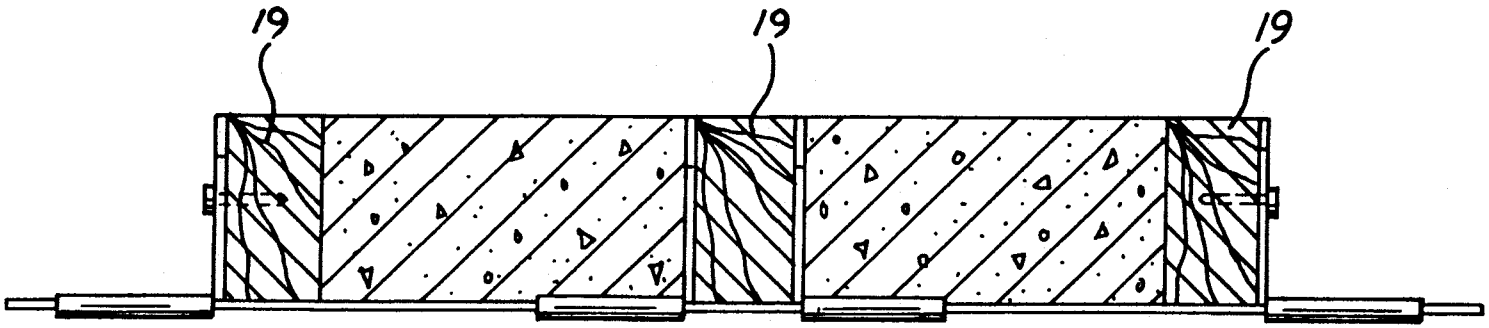

FIG. 5 is a sectional view of the present invention showing its use in forming more than one concrete slab or structure simultaneously.

DETAILED DESCRIPTION OF THE INVENTION

Referring to FIGS. *2a, 2b* and *2c,* the present invention utilizes a first substantially flat elongated member 1, 3 or 5 that extends from the exterior of the forming structure, generally designated as section 7, to the interior of the forming structure, generally designated as section 9, where a pourable formable material is to be placed. The elongated member 3, shown in FIG. *2b,* can be secured to the soil inside the forming structure through perforations 11, but more preferably the elongated member 1 (shown in FIG. *2c*) is secured through perforations 15 to a cinder block wall 13 as shown in FIG. 3 or a concrete footer (not shown). The cinder block or footer provides the foundation for the concrete structure. Once the concrete ;7 (or any pourable formable material) is placed on the portion of the elongated member 9 extending inside the forming structure, downward pressure is exerted on the elongated member which further strengthens the forming system by transferring forces resisting movement to exterior portion 7 of the elongated member 1, 3 and 5 and, subsequently, to a slidable member 21 which is secured to elongated member 1, 3 or 5. This insures against warpage of the border at form 19 or failure of the forming structure generally.

The slidable member 21 is slidably secured to the elongated member 1, 3 or 5 providing a shoring up means for the substantially vertical portion 19 of the forming system. The slidable member 21 has a series of perforations 23 which correspond with a similar series of perforations 25 in the elongated member. The slidable member 21 is placed onto the first member 1, 3 or 5 once the elongated member 1, 3 or 5 has been secured to the wall, footer or soil. A pin 27 is inserted through the perforations 25 of the elongated member and perforations 23 of slidable member 21 holding them securely together and in place. The slidable member 21 is further secured to the elongated member 1, 3 or 5 with two under-turned lips 29. These under-turned lips 29 loosely wrap around the exterior portion 7 of elongated member 1, 3 or 5 and permit the slidable member to move independent of the elongated member 1, 3 or 5.

The slidable member 21 has an upwardly extending lip 31 having at least one perforation 33 for securing form member 19 in position. Generally, the substantially vertical form member 19 will consist of wooden planks placed end to end around the periphery of the area where the concrete or pourable formable material is to be placed and held in place against upwardly extending lip 31 with a securing means inserted through perforations 33. In a preferred embodiment of the invention, the upwardly extending lip is substantially vertical.

In one embodiment, the elongated member 5 can be extended to provide two exterior ends 7; this is particularly suited for sidewalks, curbs, or narrow slabs of concrete where the distance between opposing form structures is not too great (see FIG. 1). Each opposing end of the elongated member 5 has perforation(s) 25 to cooperate with perforation(s) 23 in its cooperating slidable member 21. Each of two slidable members 21 provides one support for an opposing form member 19 on either side of the forming system. The substantially flat elongated member 5 can be secured to the soil or interior of the forming system.

Referring now to FIG. 3, there is shown the present invention installed with concrete 17 in place. Elongated member 1 extends from exterior 7 to the interior 9 and has a downward extending lip 35 for securing elongated member 1 to a cinder block wall 13 or suitable footer (not shown). A securing pin 37, which can be any form of fastening means including nails, bolts, rivets, etc., secures first elongated member 1 to cinder block wall 13. The number of securing pins 37 is dependent on the work being performed and the strength required therefor. Slidable member 21 is secured to the first elongated member 1 with pin 27. Preferably, pin 27 can be easily inserted and removed, but may be, for example, a bolt, rivet or in some circumstances slidable member 27 may be welded to elongated member 5.

Elongated member 1 and slidable member 21 can be adjusted with respect to each other to obtain the proper configuration for form member 19, including straight and curved border configurations.

FIG. 4 shows a further embodiment of the present invention whereby concrete 17 is being placed on soil instead of on a footer or cinder block wall as shown in FIG. 3. Elongated member 3 extends from an exterior portion 7 to an interior portion 9. At the interior portion 9 there is at least one and preferably a plurality of perforations 11 whereby stake(s) 39, which may be wood or metal or other suitable securing means, can be driven through perforations 11 to assist in securing the forming system. As shown in FIG. 3 and similarly in FIG. 4, a second slidable member 21 is placed onto the exterior portion 7 of the first elongated member 1, 3, and is adjusted to obtain the desired form member 19 configuration. In either case, whether using elongated member 1 or elongated member 3, once the concrete or other pourable form material 17 is in place on the interior of the elongated member 9, the downward pressure of the concrete tends to immobilize elongated member 1, 3 and slidable member 21, thereby fixing the form member 19 in place.

Referring now to FIG. 5, there is shown another embodiment of the present invention which is useful, for example, if it is necessary to maintain a screed board through the center of a slab, or if it is desired to pour two substantially parallel concrete slabs. A plurality of slidable members 21 can be inserted onto a single elongated member 5 to support a plurality of form members 19. In the case where slidable members are provided in the interior, it might be necessary to leave such members in the concrete along with the elongated member.

What is claimed is:

1. An apparatus for retaining a form member having an outer surface in place when placing a pourable formable material comprising:

a first substantially flat elongated member having an exterior portion for extending from said form member to a position outside said form member and an interior portion for extending from said form member into an interior area where said pourable formable material is to be placed;

a second member secured to and longitudinally movable along said exterior portion of said first member, said second member including means for bearing against said form member;

means for securing said second member in a fixed position along said first member for bearing against said outer surface of said form member; and means for immovably securing said first member with respect to said form member.

2. The apparatus of claim 1 wherein said interior portion of said first substantially flat elongated member is provided with a downwardly facing lip for rigidly holding said first member with respect to said form member in place.

3. The apparatus of claim 2 wherein said lip is perpendicular to said first substantially flat member.

4. The apparatus of claim 1 wherein each of said interior and exterior portions of said first substantially flat member is provided with a plurality of perforations.

5. The apparatus of claim 4 wherein said second member has a plurality of perforations for cooperating with said perforations in said exterior portion of said first substantially flat member.

6. The apparatus of claim 1 wherein said second member has an upward extending lip for securing said form member in place, said upwardly extending lip having means for securing said second longitudinally movable member to said form member.

7. The apparatus of claim 6 wherein said securing means for securing said second member to said form member comprises at least one perforation in said upward extending lip for accepting a fastening means.

8. The apparatus as in claims 1, 2, 3, 4, 5, 6, or 7 first substantially flat member further comprises at least one perforation in its interior portion for receiving securing means for rigidly securing said first member in place.

9. An apparatus for retaining first and second spaced apart form members in place when placing a pourable formable material therebetween, comprising:

a substantially flat elongated member for extending from a first exterior area outside said first form member into an interior area where said pourable formable material is to be placed and extending further into a second exterior area outside said second form member, said second exterior area being substantially opposite said first exterior area;

first and second spaced apart adjustable members for securing in place said two spaced apart form members, said first and second adjustable members secured to and longitudinally movable along said elongated member, said two adjustable members being placed on said elongated member in said first and second exterior areas, respectively;

means for securing said first and second adjustable members in a fixed position along said elongated member, and bearing against said first and second form members;

means for securing said first and second adjustable members in a fixed position along said first and second form members; and means for immovably securing said elongated member with respect to said form member.

10. The apparatus of claim 9 wherein said substantially flat elongated member is provided with a plurality of perforations at each exterior end portion.

11. The apparatus of claim 10 wherein each of said first and second adjustable members has a plurality of perforations for cooperating with said perforations in exterior end portions of said first substantially flat member.

12. The apparatus of claim 9 wherein each of said adjustable members has an upwardly extending lip for securing said form members in place, said lip having a means for securing said first and second adjustable members and said substantially flat member to said form members.

13. The apparatus of claim 12 wherein said securing means for securing said first and second adjustable members and said substantially flat member to said form members comprises at least one perforation in said upwardly extending lip for accepting a fastening means.

14. The apparatus as in claims 9 or 13 wherein said substantially flat elongated member further comprises at least one perforation on an interior portion for receiving a securing means for rigidly securing said elongated member in place.

15. A method for retaining a form member having an outer surface in place when placing a pourable forming material comprising:

securing a first substantially flat elongated member having an exterior portion for extending from said form member to a position outside said form member and an interior portion for extending from said form member into an interior area where said pourable forming material is to be placed, to a suitable structure on said interior area;

sliding a second member onto said exterior portion of said first substantially flat elongated member, said second member supporting said form member; and securing said second member in a fixed position along said first substantially flat elongated member for bearing against said outer surface of said form member and securing said first substantially flat elongated member with respect to said form member.

16. The method of claim 15 wherein said interior portion of said first substantially flat elongated member has a downwardly facing lip for rigidly holding said first member with respect to said form member in place, said downward facing lip being secured at its interior end portion through perforations provided in said lip and in said interior portion within proximity of said lip whereby securing means are inserted through said perforations for securing said first substantially flat elongated member.

17. A method for retaining first and second spaced apart form members in place when placing a pourable formable material therebetween, comprising:

placing a substantially flat elongated member for extending from a first exterior area outside said first form member into an interior area where said pourable formable material is to be placed and extending further into a second exterior area outside said second form member, said second exterior area being substantially opposite said first exterior area;

placing first and second spaced-apart adjustable members on said flat elongated member, said two adjustable members being placed on said elongated member in said first and second exterior areas, respectively;

securing said first and second adjustable members in a fixed position along said elongated member, said first and second adjustable members bearing against said first and second form members;

securing said first and second adjustable members in a fixed position along said first and second form members; and, securing said elongated member with respect to said form members.

* * * * *

UNITED STATES PATENT AND TRADEMARK OFFICE

CERTIFICATE OF CORRECTION

PATENT NO. : 5,234,654

DATED : August 10, 1993

INVENTOR(S) : C. D. Brooks

It is certified that error appears in the above-identified patent and that said Letters Patent is hereby corrected as shown below:

| COLUMN | LINE | |
|---|---|---|
| 3 | 55 | "concrete ;7" should read --concrete 17-- |
| 5 (Claim 8, Line 1) | 60 | after "3," delete "4," |
| 5 (Claim 8, Line 1) | 60 | after "7" insert --wherein said-- |
| 6 (Claim 11, Line 4) | 28 | after "said" delete "first" |
| 6 (Claim 14, Line 1) | 41 | "claims 9 or 13" should read --claims 9, 10, 11, 12 or 13-- |

Signed and Sealed this

Fifth Day of April, 1994

Bruce Lehman

*Attest:*

BRUCE LEHMAN

*Attesting Officer*

*Commissioner of Patents and Trademarks*